US011963552B2

(12) United States Patent
Jeong

(10) Patent No.: US 11,963,552 B2
(45) Date of Patent: Apr. 23, 2024

(54) HEATER ASSEMBLY FOR CIGARETTE-TYPE ELECTRONIC SMOKING DEVICE AND CIGARETTE-TYPE ELECTRONIC SMOKING DEVICE INCLUDING THE SAME

(71) Applicant: AMOSENSE CO., LTD., Cheonan-si (KR)

(72) Inventor: Sang Dong Jeong, Gimpo-si (KR)

(73) Assignee: Amosense Co., Ltd., Cheonan-si (KR)

( * ) Notice: Subject to any disclaimer, the term of this patent is extended or adjusted under 35 U.S.C. 154(b) by 759 days.

(21) Appl. No.: 17/043,773

(22) PCT Filed: Apr. 23, 2019

(86) PCT No.: PCT/KR2019/004864
§ 371 (c)(1),
(2) Date: Sep. 30, 2020

(87) PCT Pub. No.: WO2019/208996
PCT Pub. Date: Oct. 31, 2019

(65) Prior Publication Data

US 2021/0015154 A1 Jan. 21, 2021

(30) Foreign Application Priority Data

Apr. 24, 2018 (KR) ..... 10-2018-0047392

(51) Int. Cl.
*A24F 40/46* (2020.01)
*A24F 40/30* (2020.01)
(Continued)

(52) U.S. Cl.
CPC ..... *A24F 40/46* (2020.01); *A24F 40/30* (2020.01); *A24F 40/57* (2020.01); *A24F 40/10* (2020.01); *A24F 40/20* (2020.01)

(58) Field of Classification Search
None
See application file for complete search history.

(56) References Cited

U.S. PATENT DOCUMENTS 5,878,752 A 3/1999 Adams et al.
8,342,184 B2 1/2013 Inagaki et al.
(Continued)

FOREIGN PATENT DOCUMENTS

CA 2998538 A1 3/2017
CA 3 012 565 A1 12/2017
(Continued)

OTHER PUBLICATIONS

Extended European Search Report issued in EP19793224.7 dated Dec. 22, 2021, 9 pages.
(Continued)

*Primary Examiner* — Tho D Ta
(74) *Attorney, Agent, or Firm* — ROTHWELL, FIGG, ERNST & MANBECK, P.C.

(57) ABSTRACT

A heater assembly for a cigarette-type electronic smoking device is provided. A heater assembly for a cigarette-type electronic smoking device according to an exemplary embodiment of the present invention comprises: a smoking-vapor generation portion including a first heater configured to heat a circumference of a cigarette to generate a smoking vapor from the cigarette; a smoking-satisfaction vapor generation portion including a second heater configured to heat a liquid material so as to allow a smoking-satisfaction vapor generated from the liquid material to also be inhaled during smoking the cigarette; and a connection member configured to connect the smoking-vapor generation portion and the smoking-satisfaction vapor generation portion to each other.
(Continued)

Accordingly, the user may inhale the smoking-satisfaction vapor together with the smoking vapor during smoking the cigarette.

12 Claims, 11 Drawing Sheets

(51) Int. Cl.

| | |
|---|---|
| ***A24F 40/57*** | (2020.01) |
| *A24F 40/10* | (2020.01) |
| *A24F 40/20* | (2020.01) |

(56) References Cited

U.S. PATENT DOCUMENTS

| | | | | |
|---|---|---|---|---|
| 9,814,271 | B2 * | 11/2017 | Goggin | H05B 3/04 |
| 10,143,234 | B2 | 12/2018 | Hon | |
| 2011/0192408 | A1 | 8/2011 | Inagaki et al. | |
| 2013/0014772 | A1 | 1/2013 | Liu | |
| 2015/0013696 | A1 | 1/2015 | Plojoux et al. | |
| 2017/0071251 | A1 * | 3/2017 | Goch | A24F 40/485 |
| 2017/0188636 | A1 | 7/2017 | Li | |
| 2017/0224018 | A1 | 8/2017 | Li et al. | |
| 2017/0231285 | A1 | 8/2017 | Holzherr et al. | |
| 2017/0251721 | A1 * | 9/2017 | Rostami | A24F 40/42 |
| 2017/0347706 | A1 | 12/2017 | Aoun et al. | |

FOREIGN PATENT DOCUMENTS

| | | | | |
|---|---|---|---|---|
| CN | 104146353 | B | 10/2015 | |
| CN | 105901774 | A | 8/2016 | |
| EP | 3257386 | B1 | 6/2019 | |
| EP | 3 656 229 | A2 | 5/2020 | |
| JP | 5292410 | B2 | 9/2013 | |
| JP | 2017-511703 | A | 4/2017 | |
| KR | 101265170 | B1 | 5/2013 | |
| KR | 101667124 | B1 | 10/2016 | |
| KR | 20170069994 | A | 6/2017 | |
| KR | 20170109492 | A | 9/2017 | |
| KR | 20170117444 | A | 10/2017 | |
| RU | 2597540 | C2 | 9/2016 | |
| WO | WO-2015038981 | A2 * | 3/2015 | A24F 47/00 |
| WO | WO-2015091258 | A1 * | 6/2015 | A24B 15/16 |
| WO | 2017/207443 | A1 | 12/2017 | |

OTHER PUBLICATIONS

International Search Report cited in PCT/KR2019/004864 dated Aug. 8, 2019, 2 pages.

* cited by examiner

HEATER ASSEMBLY FOR CIGARETTE-TYPE ELECTRONIC SMOKING DEVICE AND CIGARETTE-TYPE ELECTRONIC SMOKING DEVICE INCLUDING THE SAME

CROSS REFERENCE TO RELATED APPLICATION

This application is the national phase entry of International Application No. PCT/KR2019/004864, filed on Apr. 23, 2019, designating the United States, which is based upon and claims priority to Korean Patent Applications 10-2018-0047392, filed on Apr. 24, 2018, the entire contents of which are incorporated herein by reference.

TECHNICAL FIELD

The present invention relates to a heater assembly for an electronic smoking device and a cigarette-type electronic smoking device including the same, and more particularly, to a heater assembly for an electronic smoking device, which is capable of generating an adequate amount of vapor during smoking, and a cigarette-type electronic smoking device including the same.

BACKGROUND

An electronic smoking device includes a storage, a heating or vaporizing device, and a battery. In this case, the storage includes a leaf-tobacco processed material, a leaf-tobacco extract including nicotine, a nicotine-free liquid material, or the like.

The electronic smoking device generates an aerosol by heating or vaporizing the leaf-tobacco processed material, the leaf-tobacco extract, the nicotine-free material, or the like stored therein. Accordingly, the user may inhale the aerosol generated in the electronic smoking device through an intake of the electronic smoking device while holding the electronic smoking device in his or her hand. Accordingly, the user may have an analogous feeling as when smoking a real cigarette through the inhaled aerosol.

However, a conventional electronic smoking device employs a liquid formed by mixing an undiluted nicotine solution and a liquid which are separately purchased. Accordingly, in the conventional electronic smoking device, there is present a risk that a user misuses the undiluted nicotine solution for an improper use such as manufacturing explosives instead of smoking.

To overcome such a limitation, a cigarette-type electronic smoking device in a fumigation method, in which a cigarette made of tobacco leaves is inserted and heated, has been proposed. Since the cigarette-type electronic smoking device generates a vapor for smoking by heating a cigarette using a heater, there is an advantage of tasting similar to a general cigarette as well as preventing an undiluted nicotine solution from being misused.

However, since the conventional cigarette-type electronic smoking device generates only the vapor for smoking by heating a solid stick, an amount of the generated vapor is inadequate in comparison to general tobacco such that satisfaction of the user is degraded.

In addition, a heater used for the conventional cigarette-type electronic smoking device is a blade type and implemented to have a plate shape such that a part thereof penetrates the solid stick. Accordingly, the conventional heater has a problem of ununiformly heating an entirety of the solid stick.

SUMMARY OF THE INVENTION

The present invention is directed to providing a heater assembly for a cigarette-type electronic smoking device, which is capable of generating an adequate amount of vapor during smoking, and a cigarette-type electronic smoking device including the same.

The present invention is also directed to providing a heater assembly for a cigarette-type electronic smoking device, which is capable of increasing a heated area of a cigarette and uniformly heating the cigarette regardless of positions thereof, and a cigarette-type electronic smoking device including the same.

One aspect of the present invention provides a heater assembly for a cigarette-type electronic smoking device. The heater assembly includes a smoking-vapor generation portion including a first heater configured to heat a circumference of a cigarette to generate a smoking vapor from the cigarette, a smoking-satisfaction vapor generation portion including a second heater configured to heat a liquid material so as to allow a smoking-satisfaction vapor generated from the liquid material to also be inhaled during smoking the cigarette, and a connection member configured to connect the smoking-vapor generation portion and the smoking-satisfaction vapor generation portion to each other. Accordingly, the user may inhale the smoking-satisfaction vapor together with the smoking vapor during smoking the cigarette.

The smoking-vapor generation portion and the smoking-satisfaction vapor generation portion may be connected in series so that central parts thereof communicate with each other with the connection member as a medium. Accordingly, the connection member may move the smoking-satisfaction vapor generated by the smoking-satisfaction vapor generation portion toward the smoking-vapor generation portion.

The first heater may be formed to have a hollow cylindrical shape with an open top and bottom so as to allow a part of the cigarette to be inserted thereinto.

The smoking-vapor generation portion may include the first heater, a fixing member disposed to surround an outer surface of the first heater, and a cover member disposed to surround a circumference of the fixing member and having one end detachably coupled to the connection member.

A gap filled with air may be formed between the cover member and the fixing member. Accordingly, movement of heat generated by the first heater may be blocked by the air in the gap.

The smoking-satisfaction vapor generation portion may include a storage-space-forming member having one end coupled to the connection member and in which a storage space configured to accommodate a certain amount of the liquid material is formed, an absorption member configured to absorb the liquid material from the storage space, and the second heater configured to generate the smoking-satisfaction vapor by heating the liquid material absorbed by the absorption member when power is applied.

Another aspect of the present invention provides a cigarette-type electronic smoking device including the above-described heater assembly, a case including an inlet at a position corresponding to the smoking-vapor generation portion, into which the cigarette is inserted and in which the heater assembly is embedded, a control portion disposed inside the case and configured to control overall operations of the heater assembly, and a power supply portion configured to provide driving power to the control portion.

According to the present invention, a smoking-satisfaction vapor may be generated in addition to a smoking vapor so that a user may inhale and exhale the smoking-satisfaction vapor as well as the smoking vapor so as to increase satisfaction of the user.

Also, according to the present invention, a heater may be formed to have a cylindrical shape and heat a circumference of a cigarette inserted therein so as to increase a heated area of the cigarette to uniformly heat the cigarette.

DETAILED DESCRIPTION OF THE INVENTION

Figure 1:
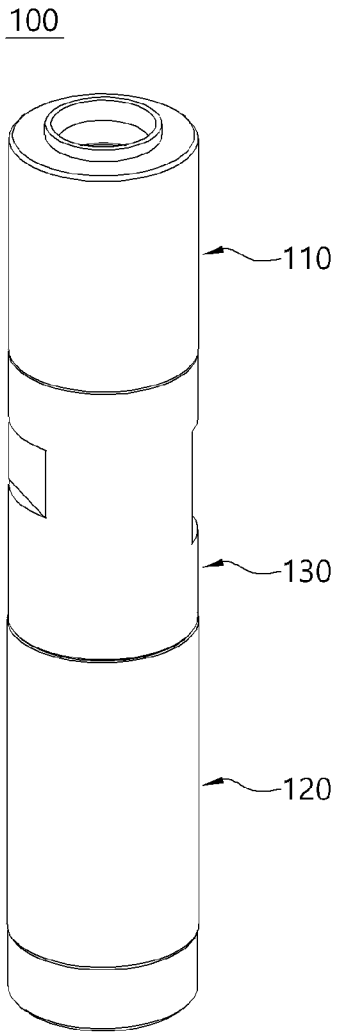
FIG. 1 is a view of a heater assembly for a cigarette-type electronic smoking device according to one embodiment of the present invention.

Hereinafter, embodiments of the present invention will be described in detail to be implemented by one of ordinary skill in the art with reference to the drawings. The present invention may be implemented in a variety of shapes and will not be limited to the embodiments described herein. To clearly describe the present invention, a description of an irrelevant part will be omitted. Throughout the specification, like or similar components will be referred to as like reference numerals.

Figure 10:
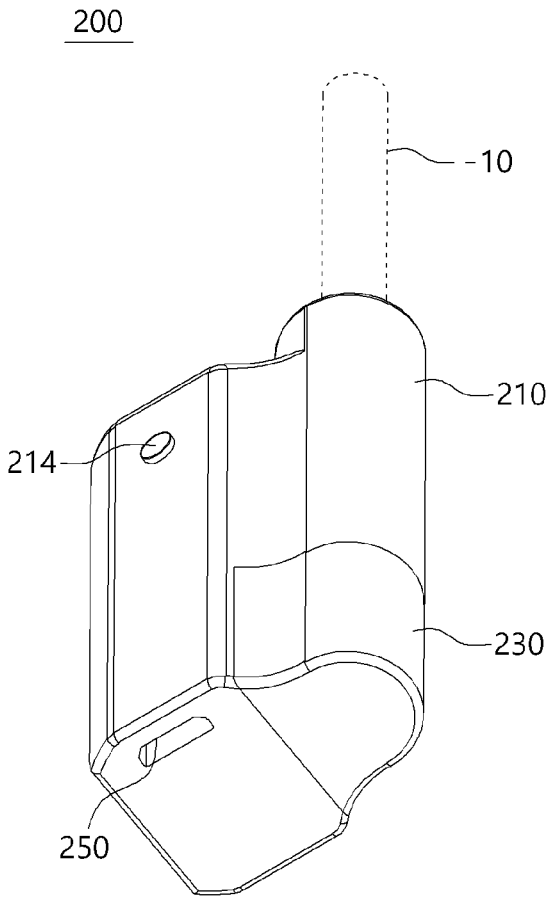
FIG. 10 is a view of a cigarette-type electronic smoking device implemented using the heater assembly for the cigarette-type electronic smoking device according to one embodiment of the present invention.

A heater assembly 100 for a cigarette-type electronic smoking device according to one embodiment of the present invention (hereinafter, referred to as the heater assembly) may generate a smoking vapor by heating a solid stick-type cigarette 10. Like this, the heater assembly 100 according to one embodiment of the present invention may be applied to a cigarette-type electronic smoking device 200 shown in FIG. 10.

In this case, the heater assembly 100 according to one embodiment of the present invention may additionally generate a smoking-satisfaction vapor in addition to a smoking vapor including nicotine. Accordingly, a user may feel increased smoking satisfaction by inhaling and exhaling a vapor amount greater than or equal to a level of a vapor amount generated when smoking using tobacco.

Figure 2:
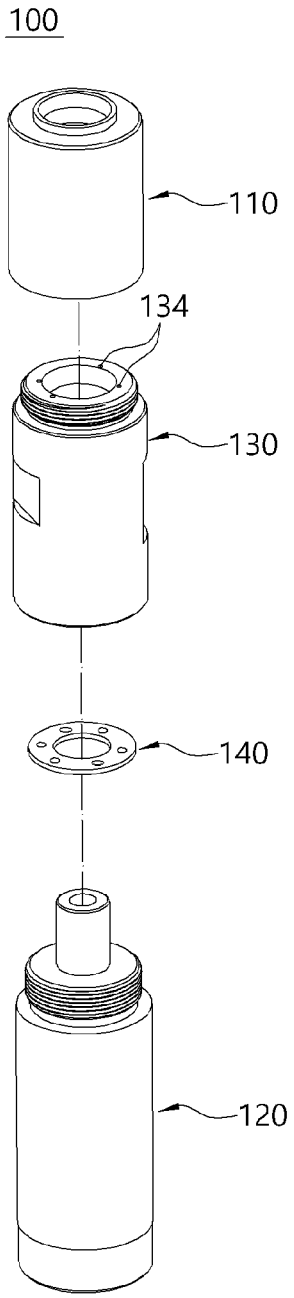
FIG. 2 is a view illustrating a state in which main components in FIG. 1 are separated.
Figure 3:
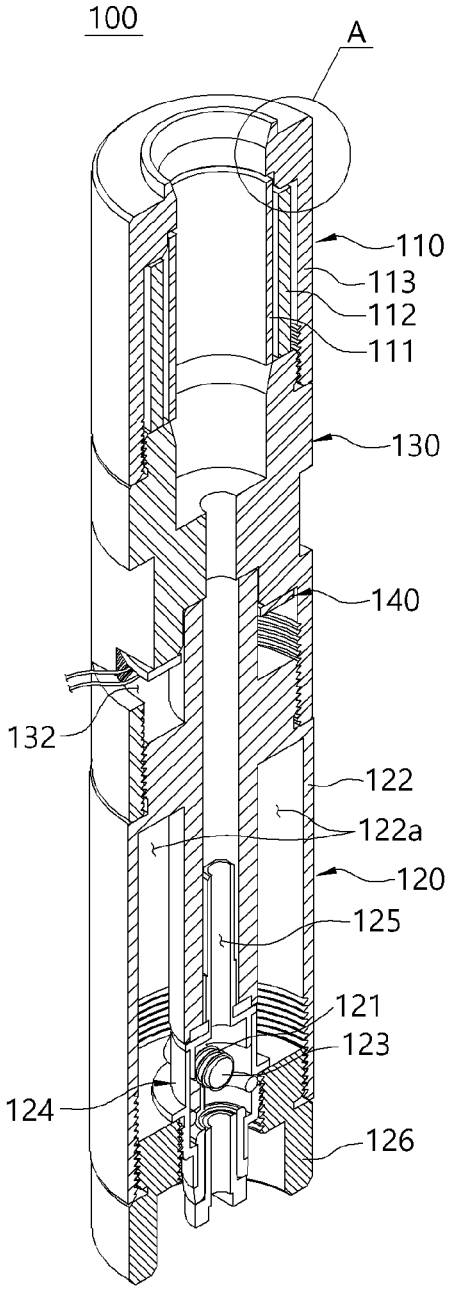
FIG. 3 is a longitudinal cross-sectional view of the device of FIG. 1.

To this end, the heater assembly 100 according to one embodiment of the present invention may include a smoking-vapor generation portion 110, a smoking-satisfaction vapor generation portion 120, and a connection member 130 as shown in FIGS. 1 to 3.

The smoking-vapor generation portion 110 may heat the cigarette 10 and generate a smoking vapor including nicotine from the cigarette 10. To this end, the smoking-vapor generation portion 110 may include a first heater 111 configured to heat the cigarette 10 when power is applied.

Figure 4:
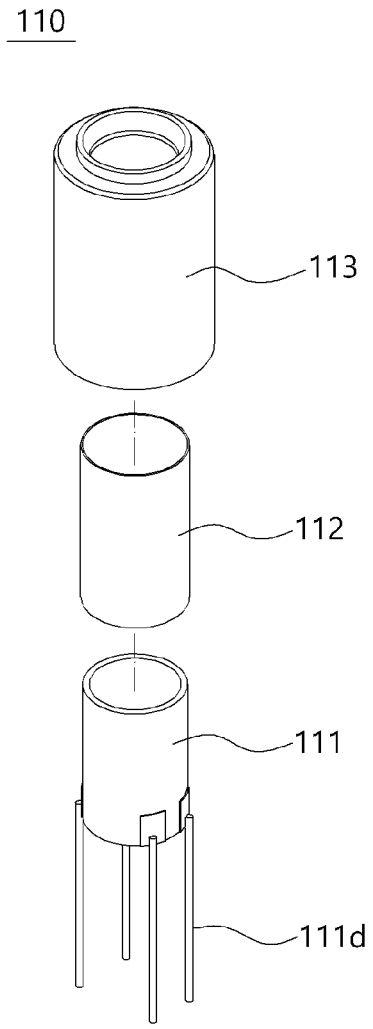
FIG. 4 is a separate view illustrating a smoking-vapor generation portion which is applicable to the heater assembly for the cigarette-type electronic smoking device according to one embodiment of the present invention.

In this case, as shown in FIG. 4, the first heater 111 may have a hollow cylindrical shape having an open top and bottom so as to allow a part of the cigarette 10, which is to be heated, to be inserted thereinto.

Accordingly, a part of an entire length of the cigarette 10 may be inserted into the first heater 111, and the part of the cigarette 10 which has been inserted into the first heater 111 may be surrounded by the first heater 111.

Accordingly, an entire circumferential surface of the part of the cigarette 10 which has been inserted into the first heater 111 may face an inner surface of the first heater 111. Accordingly, the circumferential surface of the cigarette 10 which faces the inner surface of the first heater 111 may be heated by heat provided from the first heater 111. Accordingly, a heated area of the cigarette 10 heated by the first heater 111 may be increased, and uniform heat may be provided to an entire circumferential surface.

In the present invention, the first heater 111 may be a well-known cylindrical heater used for a cigarette-type electronic smoking device. However, the first heater 111 may include a ceramic material so as to increase reliability and a life of a product even under an operational condition in which a temperature repetitively increases or decreases and to quickly transfer heat generated by a heating source.

Figure 7:
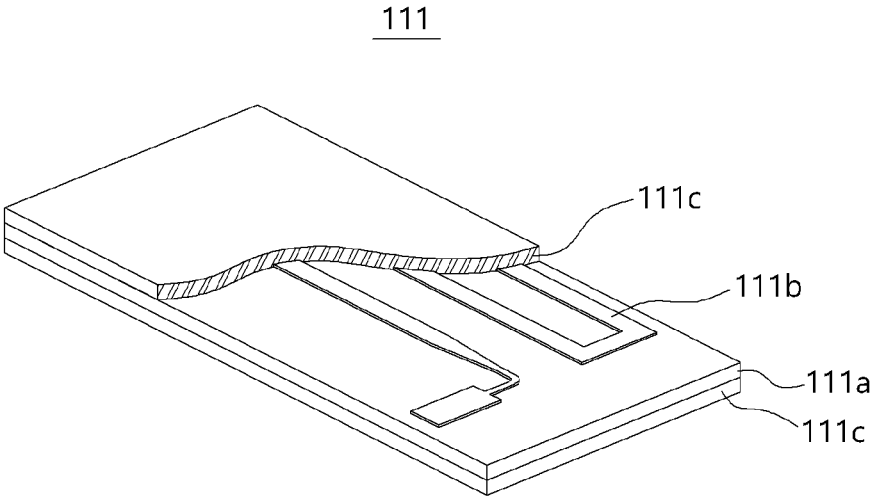
FIG. 7 is a view illustrating detailed components of a first heater which are applicable to the heater assembly for the cigarette-type electronic smoking device according to one embodiment of the present invention and illustrating a state in which the first heater is forcibly unfolded.

As an example, as shown in FIG. 7, the first heater 111 may include a support 111*a*, an electrode pattern 111*b*, and a protection layer 111*c*, and the support 111*a* may be made of a ceramic material.

As a nonrestrictive example, the support 111*a* may be a ceramic material such as alumina, $ZrO_2$, MgO, $Si_3N_4$, SiC, AlN, ZTA, and the like but is not limited thereto, and well-known ceramic materials may all be applied.

In this case, in the first heater 111, the support 111*a* may have a hollow cylindrical shape, and the electrode pattern 111*b* and the protection layer 111*c* may be disposed on one surface of the support 111*a*.

To this end, in the first heater 111, the electrode pattern 111*b* and the protection layer 111*c* may be sequentially formed on one surface of the support 111*a* having a certain area as shown in FIG. 7.

In this case, the support 111*a* may be formed by sintering a ceramic green sheet, and the electrode pattern 111*b* and the protection layer 111*c* may be sequentially formed on one surface of the ceramic green sheet in a state in which the support 111*a* is a ceramic green sheet.

Accordingly, in the first heater 111, the support 111*a* may be changed to a hollow cylindrical shape by rolling one end of the support 111*a*, which is the ceramic green sheet state, in one direction.

Here, the ceramic green sheet may be rolled so that one surface on which the electrode pattern 111*b* and the protection layer 111*c* are formed may be located inside.

Subsequently, a process of sintering the ceramic green sheet may be performed. Accordingly, the support 111*a* formed of the ceramic material is implemented to have a hollow cylindrical shape so that the first heater 111 may be formed to have a cylindrical shape having a hollow part with at least one open side. Accordingly, it can be very easy to implement the first heater 111 in a cylindrical shape.

Accordingly, in the first heater 111, when power is applied, heat generated at the electrode pattern 111*b* may move toward the support 111*a* formed of the ceramic material and then be quickly transferred to an entire area of the support 111*a*.

To this end, the first heater 111 may have an increased heating area and uniformly generate heat in an entire area at the same time. In addition, in the first heater 111, since the support 111*a* may be made of the ceramic material, reliability and a lifespan of a product can be increased under an operational condition in which a temperature is repetitively increased and decreased.

The electrode pattern 111*b* may function as a heating element configured to generate heat when power is applied. The electrode pattern 111*b* may be formed as a pattern on one surface of the support 111*a* as described above.

In this case, the electrode pattern 111*b* may be a printed pattern formed using a conductive paste. Also, the electrode pattern 111*b* may be formed through etching in a state in which a conductive member is attached to one surface of the support 111*a*. In addition, the electrode pattern 111*b* may be formed by attaching a conductive member formed in a certain pattern through shape processing such as punching to the one surface of the support 111*a*.

As a nonrestrictive example, the conductive paste and/or conductive member may be any one selected from Au, Pt, Ag, tungsten, molybdenum, and manganese or a combination of one or more thereof. However, a material of the conductive paste is not limited thereto, and any one well-known electrode material, among generally used electrode materials, capable of implementing a heating temperature required when power is applied may be adequately used.

The above electrode pattern 111*b* may be formed on one surface of the support 111*a* as described above when the support 111*a* is in the ceramic green sheet state which is not sintered.

Also, two terminals for electrical connection with another component may be formed on both ends of the electrode pattern 111*b*, and a pattern portion having a certain length may connect the two terminals.

In this case, the pattern portion may have a zigzag-bent shape to be disposed evenly in an entire area of the ceramic green sheet. Accordingly, the first heater 111 may generate heat with respect to an entire area of the support 111*a* through the pattern portion, and the first heater 111 may be implemented to be a surface-shaped heater.

However, a shape of the electrode pattern 111*b* is not limited thereto and may be adequately changed according to a design condition. In addition, the electrode pattern 111*b* may be formed in a series or in parallel or be formed in a serial-parallel mixed shape.

The protection layer 111*c* may be formed on one surface of the support 111*a* to cover the electrode pattern 111*b*. Accordingly, the electrode pattern 111*b* may be prevented, by the protection layer 111*c*, from being exposed outward.

In this case, the protection layer 111*c* may be formed of an insulating material to prevent the electrode pattern 111*b* from a short circuit with another component. Also, the protection layer 111*c* may be formed of heat-resistant and thermosetting material to prevent destruction caused by heat generated at the electrode pattern 111*b*.

As an example, the protection layer 111*c* may be made of a resin having an insulation property, a thermosetting property, and heat resistance and may be a coating layer having a certain thickness and applied to one surface of the support 111*a*.

As a detailed example, the protection layer 111*c* may be a coating layer including liquid polyimide or polyamideimide but is not limited thereto, and any one of well-known materials having an insulation property, a thermosetting property, and heat resistance may be used.

The above first heater 111 may be electrically connected to a main substrate 241 with a circuit board 140, which will be described below, through a plurality of lead portions 111*d*, and overall operations thereof may be controlled by the main substrate 241.

Figure 5:
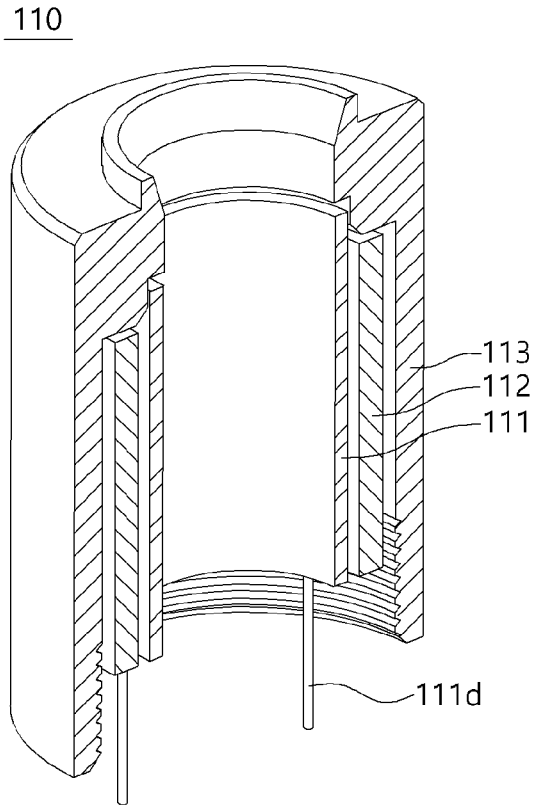
FIG. 5 is a coupling cross-sectional view of the device of FIG. 4.

Meanwhile, the smoking-vapor generation portion 110 may further include a fixing member 112 and a cover member 113 as shown in FIGS. 4 and 5, and the cover member 113 may be detachably coupled to the connection member 130 as shown in FIGS. 2 and 3.

That is, in the smoking-vapor generation portion 110, the fixing member 112 and the cover member 113 may be sequentially disposed to surround the first heater 111 and be coupled to one end side of the connection member 130 through the cover member 113.

The fixing member 112 may be disposed to surround an outer surface of the first heater 111. Accordingly, the fixing member 112 may block heat generated at the first heater 111 from being released outward and transferred to another neighboring component.

Accordingly, the heat generated at the first heater 111 may be concentrated at an inside of the first heater 111, and the heat may be concentrated at the cigarette 10 inserted in the hollow of the first heater 111.

Here, the fixing member 112 may be made of a solid material so as to protect the first heater 111 and be made of an insulating material so as to block the heat generated at the first heater 111 from being discharged. As an example, the fixing member 112 may be a plastic material.

An upper edge of the fixing member 112 may be supported by the cover member 113, and a lower edge thereof may be supported by one side of the connection member 130.

One end of the cover member 113 may be coupled to the connection member 130 so as to maintain mounting positions of the fixing member 112 and the first heater 111 as well as to protect the fixing member 112 and the first heater 111 from external environments.

To this end, the cover member 113 may be formed to have a hollow shape to surround the fixing member 112 and may have an open part corresponding to the hollow part of the first heater 111 so that the cigarette 10 inserted from the outside may enter into the inside of the first heater 111.

A lower side of the cover member 113 may be detachably coupled to the connection member 130. Accordingly, when it is necessary to replace the fixing member 112 and/or the first heater 111, the cover member 113 may be conveniently separated from the connection member 130 and the fixing member 112 and/or the first heater 111 which needs to be replaced may be easily replaced.

Figure 6:
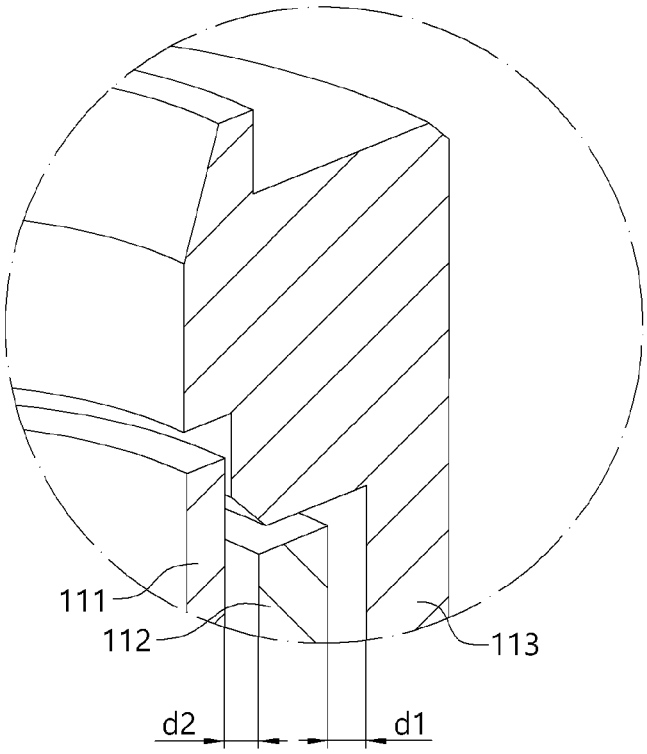
FIG. 6 is an enlarged view illustrating part A in FIG. 4.

In this case, between an inner surface of the cover member 113 and an outer surface of the fixing member 112 which face each other, a first gap d1 may be formed along a height direction of the fixing member 112 as shown in FIG. 6.

Accordingly, an air layer may be formed in the first gap d1, and the air layer may implement an insulation effect. Accordingly, the heat generated by the first heater 111 may be blocked by the air layer from moving in a direction parallel to a radial direction of the first heater 111. Accordingly, the heat generated by the first heater 111 may be further concentrated at the hollow part of the first heater 111, and an increase in a temperature of the cover member 113 may be minimized even when the first heater 111 generates heat.

In this case, a second gap d2 may be formed between an inner surface of the fixing member 112 and the outer surface of the first heater 111 which face each other. An air layer may be formed even in the second gap d2, and the air layer formed in the second gap d2 may implement an insulation effect.

Accordingly, the heat generated by the first heater 111 may be insulated two times through the air layers formed in the first gap d1 and the second gap d2. Accordingly, the heat generated by the first heater 111 may be more effectively blocked from moving in the direction parallel to the radial direction of the first heater 111.

Accordingly, the heat generated by the first heater 111 may be further concentrated at the hollow part of the first heater 111 so as to reduce a thermal loss and effectively heat the cigarette 10.

The smoking-satisfaction vapor generation portion 120 may additionally generate a smoking-satisfaction vapor without nicotine from a liquid material in addition to the smoking vapor generated by the smoking-vapor generation portion 110 using the cigarette 10.

In this case, the smoking-satisfaction vapor generated by the smoking-satisfaction vapor generation portion 120 may pass through the cigarette 10 due to a suction force of the user when the user inhales the smoking vapor generated by the smoking-vapor generation portion 110.

Accordingly, when the user smokes using the cigarette 10 inserted in the smoking-vapor generation portion 110, the user may additionally inhale the smoking-satisfaction vapor generated by the smoking-satisfaction vapor generation portion 120. Accordingly, the user may suction and discharge a greater amount of vapor in smoking.

That is, the user may additionally inhale and discharge the smoking-satisfaction vapor without nicotine and generated by the smoking-satisfaction vapor generation portion 120 in addition to the smoking vapor including nicotine and generated by the smoking-vapor generation portion 110.

Accordingly, the user may inhale and exhale an abundant amount of vapor greater than or equal to an amount of vapor generated in smoking using a general cigarette so as to increase satisfaction of smoking.

To this end, as shown in FIG. 3, the smoking-satisfaction vapor generation portion 120 may include a storage-space-forming member 122 in which a storage space 122*a* configured to accommodate a liquid material converted into a smoking-satisfaction vapor from a liquid through heating is formed and a second heater 121 configured to apply heat to the liquid material provided from the storage space 122*a*. Also, the smoking-satisfaction vapor generation portion 120 may further include an absorption member 123 configured to easily supply the liquid material stored in the storage space 122*a* from the storage space 122*a* toward the second heater 121.

In this case, the storage-space-forming member 122 may be formed as a hollow type, and one end thereof may be detachably coupled to the connection member 130. Also, the absorption member 123 may be formed to have a certain length, and the second heater 121 may be a coil wound a plurality of times along a longitudinal direction of the absorption member 123.

Accordingly, when power is supplied to the second heater 121, a liquid material supplied from the storage space 122*a* toward the second heater 121 through the absorption member 123 may be vaporized and converted into a smoking-satisfaction vapor due to heat provided by the second heater 121.

In the present invention, the liquid material may be a material which does not include nicotine and is vaporized at a temperature of 100° C. or less. As an example, the liquid material may be a liquid material including glycerin but is not limited thereto, and any materials which are vaporizable at a temperature of 300° C. or less, preferably, at a temperature of 100° C. or less are applicable.

In addition, the liquid material may be a liquid material including a nicotine material used for generating a smoking vapor in a general liquid type electronic smoking device.

Also, the absorption member 123 may be glass fibers, cotton, or fabric but is not limited thereto, and any materials capable of easily absorbing a liquid material are all applicable.

As shown in FIGS. 1 and 2, the smoking-satisfaction vapor generation portion 120 may be connected to the smoking-vapor generation portion 110 in series with the connection member 130 as a medium and the connection member 130 may be formed as a hollow with an open top and bottom. Also, the smoking-satisfaction vapor generation portion 120 may be disposed to be located below the smoking-vapor generation portion 110.

Accordingly, central parts of the smoking-vapor generation portion 110 and the smoking-satisfaction vapor generation portion 120 may communicate with each other with the connection member 130 as a medium and an smoking-satisfaction vapor generated by the smoking-satisfaction vapor generation portion 120 may easily move toward the smoking-vapor generation portion 110 through the connection member 130.

That is, the smoking-satisfaction vapor generation portion 120 is located right below the smoking-vapor generation portion 110 so that the smoking-satisfaction vapor generated by the second heater 121 may easily move toward the smoking-vapor generation portion 110 located directly thereabove.

Also, when the suction force of the user is applied in a state in which the cigarette 10 is inserted in the smoking-vapor generation portion 110, the smoking-satisfaction vapor generated by the second heater 121 may pass through the cigarette 10 and move upward due to the suction force provided by the user. Accordingly, the user may suction both the smoking vapor and smoking-satisfaction vapor.

In this case, in the heater assembly 100 according to one embodiment of the present invention when all the liquid material stored in the storage space 122*a* is exhausted, only the liquid material may be supplemented through an additional inlet (not shown) configured to communicate with the storage space 122*a* or may be supplemented by replacing the whole smoking-satisfaction vapor generation portion 120.

Accordingly, in the heater assembly 100 according to one embodiment of the present invention, when all the liquid material stored in the storage space 122*a* is exhausted, the whole smoking-satisfaction vapor generation portion 120 may be replaced so as to remove a difficulty caused by injection of the liquid material and use of a standard liquid material may be induced so as to increase reliability and stability of a product.

Figure 8:
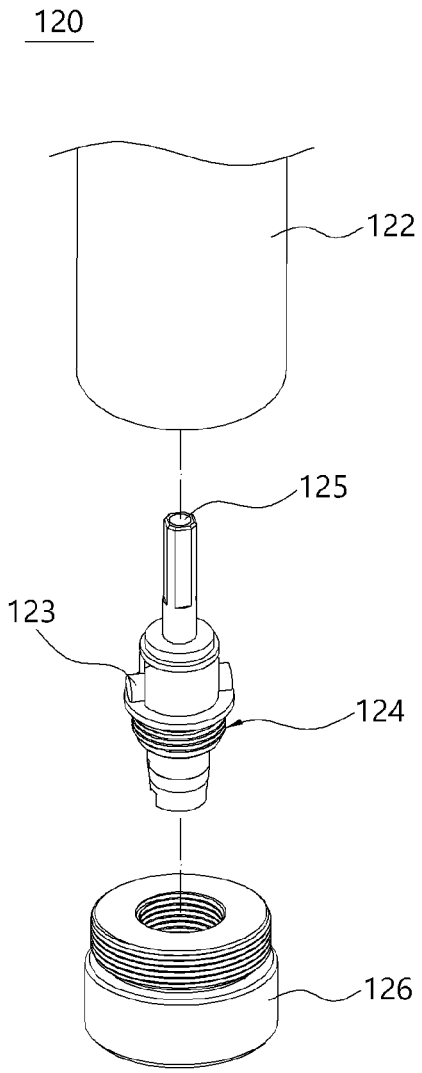
FIG. 8 is a view illustrating a state in which a smoking-satisfaction vapor portion which is applicable to the heater assembly for the cigarette-type electronic smoking device according to one embodiment of the present invention is partially separated.

To this end, the smoking-satisfaction vapor generation portion 120 may be configured in a module form which further includes a body 124 and a coupling member 126 as shown in FIG. 8 in addition to the storage-space-forming member 122, the absorption member 123, and the second heater 121 which have been described above.

In this case, as shown in FIG. 3, a movement path 125 may be formed to pass through the body 124 along a height direction so as to allow the smoking-satisfaction vapor to be movable, and the movement path 125 may be disposed to communicate with a hollow part of the storage-space-forming member 122.

Also, the absorption member 123 may be fixed to the body 124 to be disposed in a direction intersecting the movement path 125. In addition, the absorption member 123 may be fixed to the body 124 so that both ends thereof protrude toward the storage space 122*a* so as to easily absorb the liquid material stored in the storage space 122*a*.

In this case, the second heater 121 may be provided as a conductive member having a certain length and may be wound a plurality of times along a longitudinal direction of the absorption member 123.

Accordingly, the liquid material may be absorbed along the absorption member 123 and move toward the movement path 125 from the storage space 122*a*. Subsequently, the liquid material may be vaporized and converted into a smoking-satisfaction vapor by heat provided from the second heater 121, and the smoking-satisfaction vapor may move toward the connection member 130 through the movement path 125.

Also, the storage-space-forming member 122 may be detachably fastened to the coupling member 126 so as to surround at least a part of the body 124. Accordingly, an open lower portion of the storage space 122*a* may be sealed by the coupling member 126.

Here, both the body 124 and the storage-space-forming member 122 may be formed to have a hollow shape so as to be detachably coupled to the coupling member 126. As an example, the body 124 may be coupled to a hollow part of the coupling member 126, and the storage-space-forming member 122 may be coupled to surround a part of the coupling member 126.

Meanwhile, the body 124 may be formed as a single member but may be formed by coupling a plurality of members to each other.

Figure 9:
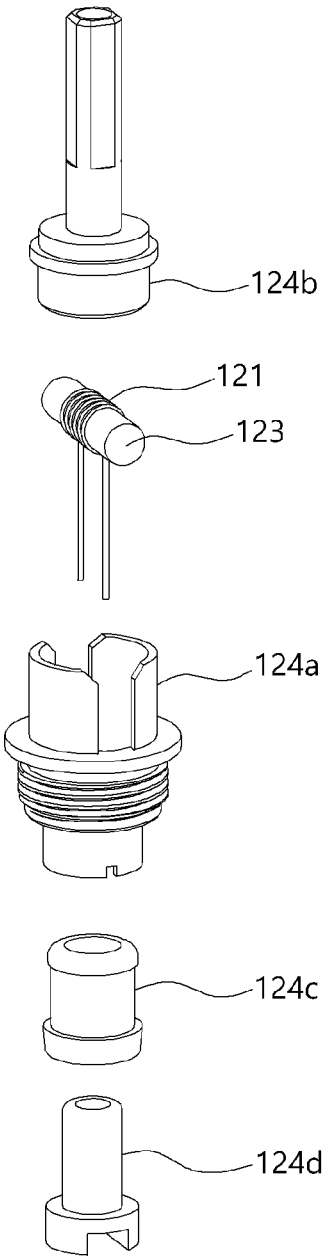
FIG. 9 is a separate view illustrating a coupling relationship between a body, a second heater, an absorption member, an insulation member, and a conducting member in the smoking-satisfaction vapor generation portion which is applicable to the heater assembly for the cigarette-type electronic smoking device according to one embodiment of the present invention.

As an example, as shown in FIG. 9, the body 124 may include a first body 124*a*, a second body 124*b*, an insulation member 124*c*, and a conducting member 124*d*. Also, all of the first body 124*a*, the second body 124*b*, and the insulation member 124*c* may be formed to have a hollow shape.

In this case, the second body 124*b* may be coupled to an upper side of the first body 124*a*, and the conducting member 124*d* may be coupled to a lower side of the first body 124*a* with the insulation member 124*c* as a medium.

Here, the insulation member 124*c* may be disposed to be located between an outer surface of the conducting member 124*d* and an inner surface of the first body 124*a*. Accordingly, the first body 124*a* and the conducting member 124*d* may be blocked from being conducted to each other through the insulation member 124*c*.

Accordingly, hollow parts of the second body 124*b*, the first body 124*a*, and the conducting member 124*d* may communicate with one another so as to form the movement path 125. Also, both ends of the absorption member 123 on which the second heater 121 is wound may be fixed to the first body 124*a* when the first body 124*a* and the second body 124*b* are coupled.

In this case, the first body 124*a*, the conducting member 124*d*, and the coupling member 126 may be made of a conductive material such as a metal. Also, both ends of a conductive material composed of the second heater 121 may be connected to the first body 124*a* and the conducting member 124*d*.

Accordingly, the second heater 121 may be electrically connected to an external power source through the first body 124*a* and the conducting member 124*d*.

However, the body is not limited thereto and may be formed by coupling an adequate number of members to each other or may be one hollow type member in which the movement path is formed along a longitudinal direction.

Also, it should be noted that components of the smoking-satisfaction vapor generation portion 120 is not limited to the above structure and detailed components thereof may adequately vary according to design conditions when a smoking-satisfaction vapor may be generated by heating a liquid material provided from the storage space 122*a* using the second heater 121.

The connection member 130 may be disposed between the smoking-vapor generation portion 110 and the smoking-satisfaction vapor generation portion 120 so as to connect the smoking-vapor generation portion 110 and the smoking-satisfaction vapor generation portion 120 to each other. Accordingly, the smoking-vapor generation portion 110 and the smoking-satisfaction vapor generation portion 120 may be connected to each other in series with the connection member 130 as a medium.

In this case, the connection member 130 may be formed as a hollow shape so that the smoking-satisfaction vapor generated at the smoking-satisfaction vapor generation portion 120 may move toward the smoking-vapor generation portion 110. Accordingly, the smoking-satisfaction vapor generated by the smoking-satisfaction vapor generation portion 120 may easily move toward the smoking-vapor generation portion 110 on a liner path without being bent.

Accordingly, the smoking-satisfaction vapor generated by the smoking-satisfaction vapor generation portion 120 may quickly move toward the smoking-vapor generation portion 110 along the linear path so as to minimize the smoking-satisfaction vapor from being changed to a liquid during a movement process. Accordingly, an adequate amount of the smoking-satisfaction vapor generated by smoking-satisfaction vapor generation portion 120 may be supplied toward the smoking-vapor generation portion 110.

Also, in a case in which a suction force is provided through a cigarette inserted in the smoking-vapor generation portion 110, the smoking-satisfaction vapor generated by the smoking-satisfaction vapor generation portion 120 may easily move toward the smoking-vapor generation portion 110 along the linear path due to the suction force. Accordingly, the user may inhale the adequate amount of smoking-satisfaction vapor so as to increase satisfaction of use.

Meanwhile, as shown in FIGS. 2 and 3, the circuit board 140 electrically connected to the first heater 111 may be disposed on a lower side of the connection member 130. The circuit board 140 may be electrically connected to the first heater 111 with a cable as a medium.

That is, a lead portion 111*d* of the first heater 111 may be connected to the circuit board 140, and the circuit board 140 may be electrically connected to another component with a separate cable as a medium. As an example, the circuit board 140 may be electrically connected to the main substrate 241 of the cigarette-type electronic smoking device 200, which will be described below, with a cable as a medium. Also, the circuit board 140 may be fixed to the connection member 130 with the fixing member as a medium.

In this case, as shown in FIG. 3, the connection member 130 may include an opening portion 132 at a position corresponding to the circuit board 140 to expose the circuit board 140 to the outside.

Accordingly, a cable for electrical connection to the circuit board 140 may enter through the opening portion 132, and power supplied from the outside may be supplied to the circuit board 140 through the cable.

In this case, as shown in FIG. 2, a plurality of lead portion disposition holes 134 may be formed to pass through the connection member 130 along a height direction to allow the plurality of lead portions 111*d* to pass therethrough, and the plurality of lead portions 111*d* may pass through the lead portion disposition holes 134.

Accordingly, the lead portions 111*d* configured to electrically connect the first heater 111 to the circuit board 140 may be protected by the lead portion disposition holes 134. Accordingly, the lead portions 111*d* may be prevented from being disconnected by an external shock such as a fall. Accordingly, the heater assembly 100 according to one embodiment of the present invention may overcome all limitations such as an electrical disconnection and increase reliability of a product.

The above heater assembly 100 may be implemented as the cigarette-type electronic smoking device 200.

That is, the cigarette-type electronic smoking device 200 according to one embodiment of the present invention may include the heater assembly 100, a case 210, a control portion, and a power supply portion 220 as shown in FIGS. 10 to 13.

The heater assembly 100 may include the smoking-vapor generation portion 110, the smoking-satisfaction vapor generation portion 120, and the connection member 130 and be accommodated in the case 210 with the control portion and the power supply portion 220.

In this case, the heater assembly 100 may receive driving power from the power supply portion 220, and overall operations may be controlled by driving of the control portion.

As an example, the first heater 111 and the second heater 121 may be operated under control of the control portion. When the first heater 111 and the second heater 121 operate, the smoking vapor and the smoking-satisfaction vapor may be generated from the cigarette inserted in the smoking-vapor generation portion 110 and the liquid material included in the smoking-satisfaction vapor generation portion 120, respectively.

In the embodiment, since the smoking-vapor generation portion 110, the smoking-satisfaction vapor generation portion 120, and the connection member 130 which are included in the heater assembly 100 are equal to the above description, a detailed description thereof will be omitted.

Figure 11:
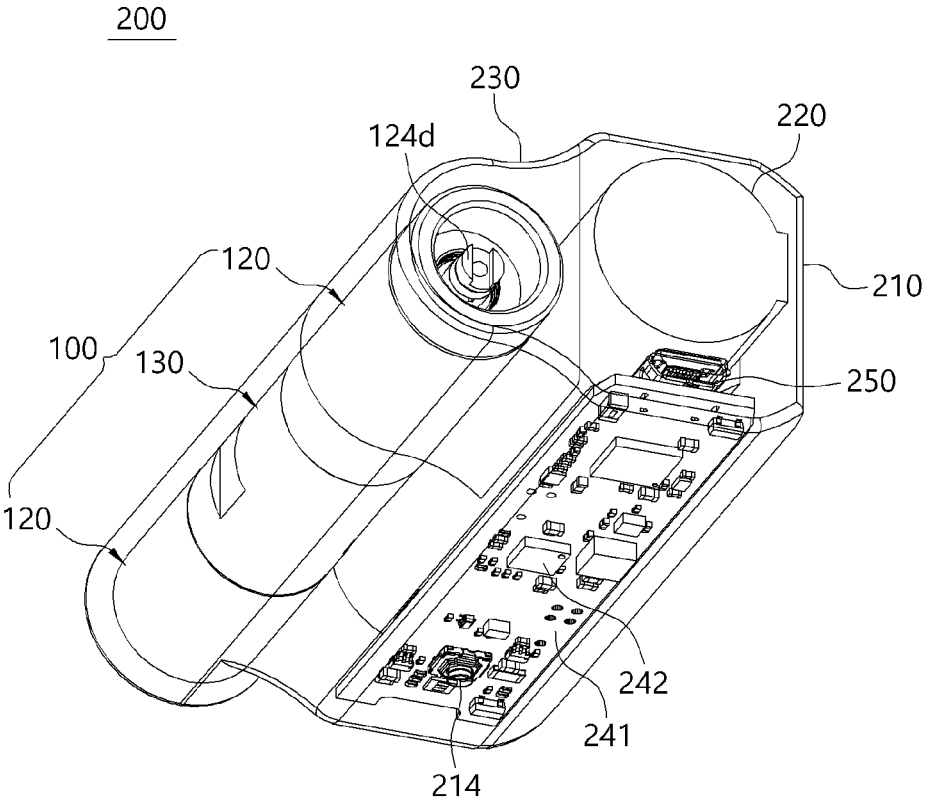
FIG. 11 is a view illustrating internal components of FIG. 10.
Figure 12:
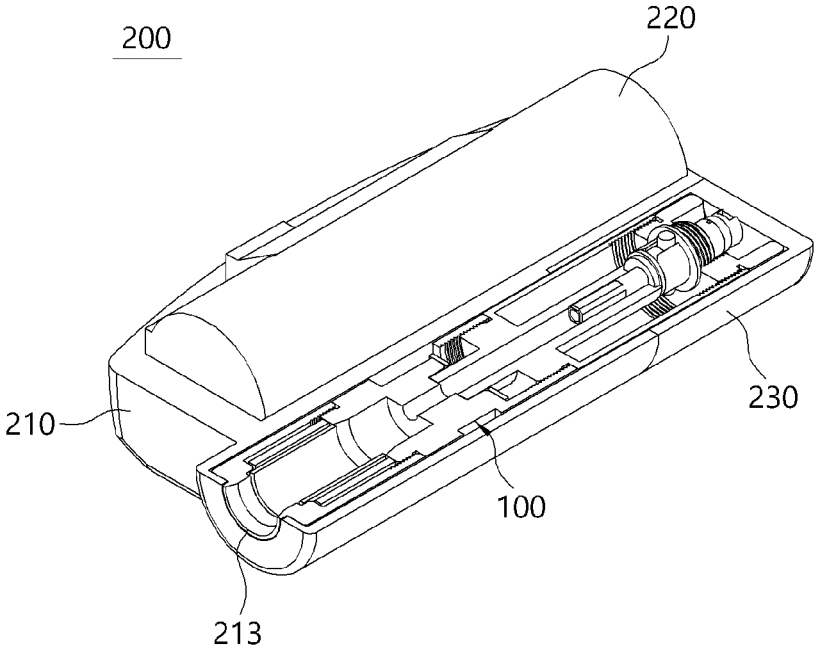
FIG. 12 is a view illustrating a case of FIG. 10 which is partially cut.

Also, the power supply portion 220 may be a well-known battery, and the battery may be a primary cell or a secondary cell. In addition, as shown in FIG. 11, the control portion may include the main substrate 241 and a chip set 242 such as a micro control unit (MCU) mounted on one surface of the main substrate 241, and the main substrate 241 may further include a variety of circuits for driving the cigarette-type electronic smoking device 200.

Meanwhile, the case 210 may accommodate the heater assembly 100, the control portion, and the power supply portion 220 therein, and the heater assembly 100 and the power supply portion 220 may be disposed side by side in the case 210.

Figure 13:
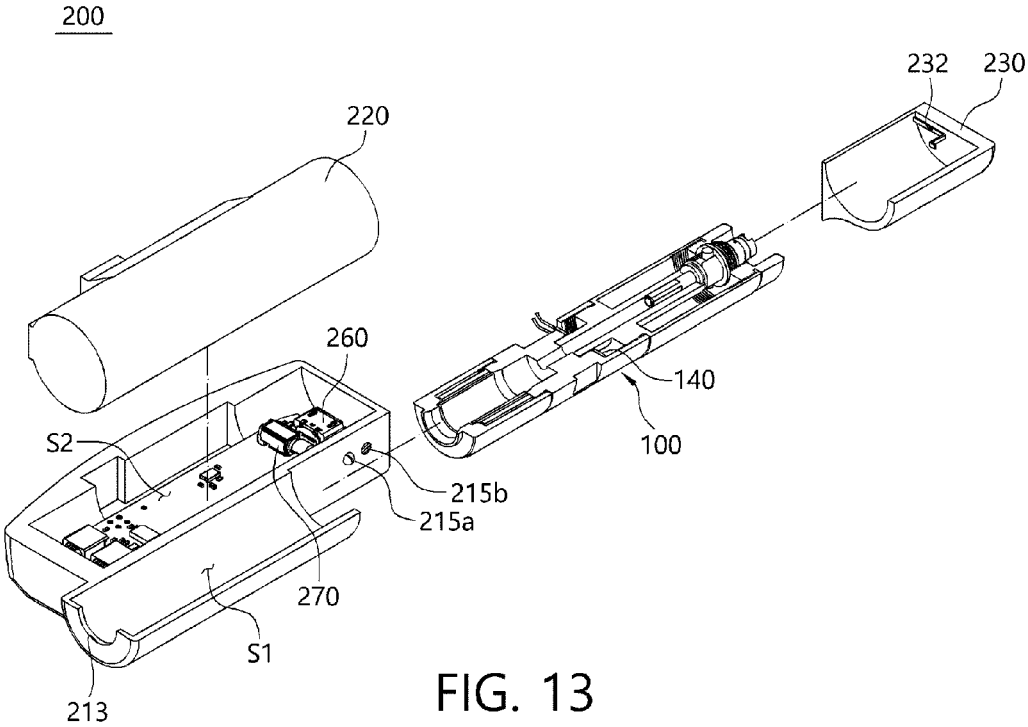
FIG. 13 is a view illustrating a state in which a cover member, a power supply portion, and a heater assembly in FIG. 12 are separate.

As an example, the case 210 may include a first space S1 for accommodating the heater assembly 100 and a second space S2 for accommodating the control portion and the power supply portion 220. As shown in FIG. 13, the first space S1 and the second space S2 may be formed to be disposed side by side along a height direction of the case 210. Alternatively, the first space S1 and the second space S2 may be formed as one space in the case 210.

Here, in the heater assembly 100 inserted in the first space S1, the circuit board 140 may be electrically connected to the main substrate 241 included in the control portion with a cable as a medium as described above. Accordingly, driving of the first heater 111 may be controlled by the control portion.

In this case, the case 210 may include an inlet 213 formed to pass therethrough so as to allow the cigarette 10 to be inserted thereinto. As an example, the inlet 213 may be formed in a top surface of the case 210 at a position corresponding to the hollow part of the smoking-vapor generation portion 110.

Accordingly, when the cigarette 10 is inserted into the inlet 213, a part of an entire length of the cigarette 10 may be inserted into the hollow part of the first heater 111. Accordingly, the cigarette 10 inserted into the hollow part of the first heater 111 may be heated by heat provided from the first heater 111 and generate a smoking vapor.

Meanwhile, as shown in FIG. 13, the cigarette-type electronic smoking device 200 according to one embodiment of the present invention may include a charging port 260 configured to recharge the power supply portion 220, and the charging port 260 may be mounted on the main substrate 241. Also, an exposure hole 250 may be formed in one side of the case 210 so as to expose the charging port 260 to the outside.

As an example, the charging port 260 may be a well-known universal serial bus (USB) connector, and the charging port 260 may be connected to an external charger through the exposure hole 250 with a well-known charging cable as a medium. Accordingly, the power supply portion 220 may be recharged by power provided from the outside.

In addition, the cigarette-type electronic smoking device 200 may further include a notification means configured to output a certain signal to allow the user to easily recognize a variety of pieces of information such as on/off of power, an operational time of the first and second heaters 111 and 121, and a smoking available/unavailable state, and the like.

As an example, the notification means may be a vibration motor 270 mounted on one surface of the main substrate 241 as shown in FIG. 13, and the vibration motor 270 may output vibrations through driving of the control portion when notification is necessary. However, the notification means is not limited thereto and a sound output method, a text display method, a light-on method, light-off method, or a combination of two or more of the methods may be employed.

Also, the cigarette-type electronic smoking device 200 may include a wireless communication function capable of transmitting or receiving a state of an external device or smoking-related information such as an inhalation number through wireless communication with the external device. As an example, the wireless communication function may be Bluetooth or near field communication (NFC) but is not limited thereto and all a variety of well-known wireless communication methods may be applied.

In addition, the cigarette-type electronic smoking device 200 may include a button portion 214 provided on one side of the case 210 to allow the user to turn power on or off.

Meanwhile, the cigarette-type electronic smoking device 200 may include the cover member 230 detachably coupled to one side of the case 210. Accordingly, when the cover member 230 is separated from the case 210, the heater assembly 100 disposed in the first space Si of the case may be partially exposed to the outside.

As an example, when the cover member 230 is separated from the case 210, the smoking-satisfaction vapor generation portion 120 may be exposed to the outside.

To this end, the cover member 230 may be detachably coupled to the case 210 at a position corresponding to the smoking-satisfaction vapor generation portion 120.

Accordingly, when all the liquid material stored in the storage space 122*a* is exhausted, the user may expose the smoking-satisfaction vapor generation portion 120 to the outside by separating the cover member 230 from the case 210 and may simply separate the externally exposed smoking-satisfaction vapor generation portion 120 from the connection member 130. Accordingly, the smoking-satisfaction vapor generation portion 120 may be simply replaced when necessary.

In this case, as shown in FIG. 13, the cover member 230 may include a contact terminal 232 configured to electrically connect the second heater 121 of the smoking-satisfaction vapor generation portion 120 to the main substrate 241.

As an example, the contact terminal 232 may be formed by bending a conductive member having a certain length one time or more and may have at least a part thereof which partially protrudes upward.

In this case, a pair of contact terminals 215*a* and 215*b* for electrical connection with the smoking-satisfaction vapor generation portion 120 may be provided on one side of the case 210, and the pair of contact terminals 215*a* and 215*b* may be in a state of being electrically connected to the main substrate 241.

In the embodiment, any one of the pair of contact terminals 215*a* and 215*b* may come into direct contact with an outer surface of the coupling member 126 included in the smoking-satisfaction vapor generation portion 120, and another may come into contact with the contact terminal 232 included in the cover member 230 when the cover member 230 is coupled to the case 210. In addition, at least any one of the pair of contact terminals 215*a* and 215*b* may be a ball-plunger type.

Accordingly, when the heater assembly 100 is inserted into the first space S1 of the case and the cover member 230 is coupled to the case 210, a protruding part of the contact terminal 232 included in the cover member 230 may come into contact with a lower end of the conducting member 124*d* included in the smoking-satisfaction vapor generation portion 120. Accordingly, the conducting member 124*d* may be electrically connected to the main substrate 241 through the contact terminal 232.

Also, as described above, when the heater assembly 100 is inserted into the first space S1 of the case, the coupling member 126 may remain in a state of being in contact with any one 215*a* of the pair of contact terminals 215*a* and 215*b* so as to be electrically connected to the main substrate 241.

Accordingly, both ends of the second heater 121 are electrically connected to the main substrate 241 so that driving thereof may be controlled by the control portion.

Although one embodiment of the present invention has been described above, the concept of the present invention is not limited to the embodiment disclosed herein and it should be understood that one of ordinary skill in the art who understands the concept of the present invention may easily provide other embodiments through addition, changes, elimination, and the like of components without departing from the scope of the same concept which will be included in the scope of the concept of the present invention.

The invention claimed is:

1. A heater assembly for a cigarette-type electronic smoking device, comprising:

a smoking-vapor generation portion including a first heater configured to heat a circumference of a cigarette to generate a smoking vapor from the cigarette;

a smoking-satisfaction vapor generation portion including a second heater configured to heat a liquid material so as to allow a smoking-satisfaction vapor generated from the liquid material to also be inhaled during smoking the cigarette; and a connection member configured to connect the smoking-vapor generation portion and the smoking-satisfaction vapor generation portion to each other, wherein the first heater has a hollow cylindrical shape with an open top and bottom so as to allow a part of the cigarette to be inserted thereinto.

2. The heater assembly of claim 1, wherein the smoking-vapor generation portion and the smoking-satisfaction vapor generation portion are connected in series so that central parts thereof communicate with each other with the connection member as a medium.

3. The heater assembly of claim 1, wherein the connection member has a hollow shape to allow the smoking-satisfaction vapor generated by the smoking-satisfaction vapor generation portion to move toward the smoking-vapor generation portion.

4. The heater assembly of claim 1, wherein the smoking-satisfaction vapor passes through an interior of the cigarette and then is inhaled with the smoking vapor due to a suction force generated during smoking the cigarette.

5. The heater assembly of claim 1, wherein the first heater comprises:

a support made of a ceramic material and having a hollow shape;

an electrode pattern formed as a pattern on one surface of the support to generate heat when power is applied; and a protection layer having an insulation property and heat resistance and configured to cover the electrode pattern.

6. A heater assembly for a cigarette-type electronic smoking device, comprising:

a smoking-vapor generation portion including a first heater configured to heat a circumference of a cigarette to generate a smoking vapor from the cigarette;

a smoking-satisfaction vapor generation portion including a second heater configured to heat a liquid material so as to allow a smoking-satisfaction vapor generated from the liquid material to also be inhaled during smoking the cigarette; and a connection member configured to connect the smoking-vapor generation portion and the smoking-satisfaction vapor generation portion to each other, wherein the smoking-vapor generation portion comprises:

the first heater;

a fixing member disposed to surround an outer surface of the first heater; and a cover member disposed to surround a circumference of the fixing member and having one end detachably coupled to the connection member.

7. The heater assembly of claim 6, comprising a gap filled with air is formed between the cover member and the fixing member.

8. A heater assembly for a cigarette-type electronic smoking device, comprising:

a smoking-vapor generation portion including a first heater configured to heat a circumference of a cigarette to generate a smoking vapor from the cigarette;

a smoking-satisfaction vapor generation portion including a second heater configured to heat a liquid material so as to allow a smoking-satisfaction vapor generated from the liquid material to also be inhaled during smoking the cigarette; and a connection member configured to connect the smoking-vapor generation portion and the smoking-satisfaction vapor generation portion to each other, wherein the smoking-satisfaction vapor generation portion comprises:

a storage-space-forming member having one end coupled to the connection member and having a storage space configured to accommodate a certain amount of the liquid material;

an absorption member configured to absorb the liquid material from the storage space; and the second heater configured to generate the smoking-satisfaction vapor by heating the liquid material absorbed by the absorption member when power is applied, wherein the smoking-satisfaction vapor generation portion further comprises a body in which a movement path is formed along a longitudinal direction so that the smoking-satisfaction vapor generated by the second heater is movable toward the smoking-vapor generation portion, and wherein the absorption member is disposed in a direction intersecting the movement path.

9. The heater assembly of claim 8, wherein the smoking-satisfaction vapor generation portion further comprises a coupling member detachably coupled to a lower part of the storage-space-forming member, and wherein the coupling member fixes the body and seals an open lower portion of the storage space.

10. A heater assembly for a cigarette-type electronic smoking device, comprising:

a smoking-vapor generation portion including a first heater configured to heat a circumference of a cigarette to generate a smoking vapor from the cigarette;

a smoking-satisfaction vapor generation portion including a second heater configured to heat a liquid material so as to allow a smoking-satisfaction vapor generated from the liquid material to also be inhaled during smoking the cigarette; and a connection member configured to connect the smoking-vapor generation portion and the smoking-satisfaction vapor generation portion to each other, wherein a circuit board electrically connected to the first heater is disposed inside the connection member, and wherein the connection member includes an opening portion formed in one side thereof to expose a part of the circuit board to the outside.

11. A cigarette-type electronic smoking device comprising:

a heater assembly;

a case including an inlet at a position corresponding to a smoking-vapor generation portion of the heater assembly, configured for insertion of a cigarette, and in which the heater assembly is embedded;

a control portion disposed inside the case and configured to control overall operations of the heater assembly; and a power supply portion configured to provide driving power to the control portion wherein the heater assembly comprises:

the smoking-vapor generation portion including a first heater configured to heat a circumference of a cigarette to generate a smoking vapor from the cigarette;

a smoking-satisfaction vapor generation portion including a second heater configured to heat a liquid material so as to allow a smoking-satisfaction vapor generated from the liquid material to also be inhaled during smoking the cigarette; and a connection member configured to connect the smoking-vapor generation portion and the smoking-satisfaction vapor generation portion to each other.

12. The cigarette-type electronic smoking device of claim 11, comprising a cover member to be detachably coupled to the case at a position corresponding to the smoking-satisfaction vapor generation portion, wherein the cover member includes a contact terminal for electrical connection with the second heater.

* * * * *